US005745830A

United States Patent [19]

Fujiwara et al.

[11] Patent Number: 5,745,830

[45] Date of Patent: Apr. 28, 1998

[54] INTERMEDIATE TRANSFER MEMBER FOR IMAGE FORMING APPARATUS

[75] Inventors: Toshimitsu Fujiwara, Kobe; Shuji Iino, Muko; Hidetoshi Miyamoto, Takatsuki, all of Japan

[73] Assignee: Minolta Co., Ltd., Osaka, Japan

[21] Appl. No.: 566,054

[22] Filed: Dec. 1, 1995

[30] Foreign Application Priority Data

Dec. 2, 1994 [JP] Japan ..... 6-299621

[51] Int. Cl.[6] ..... G03G 15/16

[52] U.S. Cl. ..... 399/308; 430/126

[58] Field of Search ..... 355/256, 271–279; 430/126; 399/302, 308

[56] References Cited

U.S. PATENT DOCUMENTS

| | | | |
|---|---|---|---|
| 4,984,025 | 1/1991 | Landa et al. | 355/274 |
| 4,999,677 | 3/1991 | Landa et al. | 355/273 |
| 5,089,856 | 2/1992 | Landa et al. | 355/279 |
| 5,303,013 | 4/1994 | Koike et al. | 355/271 |
| 5,370,961 | 12/1994 | Zaretsky et al. | 430/126 |
| 5,387,760 | 2/1995 | Miyazawa et al. | 355/256 X |
| 5,398,107 | 3/1995 | Bartholmae et al. | 355/273 |
| 5,438,398 | 8/1995 | Tanigawa et al. | 355/271 |
| 5,530,532 | 6/1996 | Iino et al. | 399/308 X |

FOREIGN PATENT DOCUMENTS

| | | |
|---|---|---|
| 4-335381 | 11/1992 | Japan . |
| 5-232823 | 9/1993 | Japan . |

*Primary Examiner*—Arthur T. Grimley
*Assistant Examiner*—Sophia S. Chen
*Attorney, Agent, or Firm*—McDermott, Will & Emery

[57] ABSTRACT

An intermediate transfer member for use in image forming apparatus which produce images by transferring a toner image formed on an image-bearing member to an intermediate transfer member, and transferring the toner image held on said intermediate transfer member to a recording medium. The intermediate transfer member comprises at least three layers of a conductive substrate, intermediate layer, and surface layer, and the volume resistivity of said surface layer is lower than the volume resistivity of said intermediate layer.

9 Claims, 3 Drawing Sheets

INTERMEDIATE TRANSFER MEMBER FOR IMAGE FORMING APPARATUS

BACKGROUND OF THE INVENTION

1. Field of the Invention

The present invention relates to an intermediate transfer member for use with image forming apparatus which develop electrostatic latent images formed on a latent image-bearing member by toner.

2. Description of the Related Art

In recent years, electrophotographic methods used in copiers and printers and the like have come to be used in desktop publishing output devices. There has also come to be particularly strong demand for high definition image quality of electrophotographic images in conjunction with divergent demands such as that for colorization.

In general, the transfer paper used in image forming apparatus have various thicknesses, dielectric constant, electrical resistance and the like. Therefore, when a toner image is electrostatically transferred directly from a latent image-bearing member to a transfer sheet, a desired toner density may not be obtainable due to changes of transfer efficiency in conjunction with the transfer sheet used. Accordingly, to obtain high definition images, a recording member must be used which has excellent transfer efficiency, e.g., limited to transfer sheets thinner than is typical or coated paper or the like, which presents problems relative to plain paper and overhead projection transparencies. In the case of full color images, three of four transfers are required to overlay toner images of each color and thereby markedly aggravating the aforesaid problem. In construction which directly transfer a toner image from the surface of a latent image-bearing member onto a transfer sheet, paper debris adheres to the latent image-bearing member during said transfer, causing the disadvantage of reducing the functionality of the cleaner and developer.

U.S. Pat. Nos. 5,089,856, and 4,999,677, and 4,984,025, as well as Japanese Unexamined Patent Application No. HEI 5-232823 disclose image transfer methods using intermediate transfer members in order to resolve the aforesaid disadvantages. Image transfer methods using an intermediate transfer member develop the latent image on the surface of a latent image-bearing member as a toner image and subsequently bring the intermediate transfer drum (belt) into contact with the image-bearing member and transfer the toner image at once to the intermediate transfer drum (belt) via the effect of an electric field formed between said image-bearing member and said intermediate transfer drum (belt). Thereafter, the transferred toner image is transferred onto a final medium such as a recording sheet or the like by means of heat and pressure or electrostatic force generated by an electric field so as to complete the series of the copy operation. Use of an intermediate transfer member allows the selection of the recording media to be eliminated because the intermediate transfer member possesses the transfer characteristics required to transfer the toner image from the surface of the image-bearing member. Thus, plain paper and overhead projection transparencies may be used, and full color reproduction is possible by overlaying toner images.

In the aforesaid intermediate transfer method, various arts are used to improve transfer efficiency and produce flawless and faithful transfer images.

In general, an intermediate transfer member is constructed by a rubber material or the like which has been treated by a process to provide an electrically conductive surface layer wrapped around an electrically conductive substrate such as aluminum or the like to which a bias voltage can be applied. Whether or not a toner image formed on the surface of an image-bearing member can be adequately transferred originates in the characteristics of the part of the intermediate transfer member which comes into contact with the image-bearing member, i.e., the resistance value of the surface layer formed of rubber material or the like. The transfer efficiency can be improved because the lower the volume resistivity of the surface layer of the transfer member, the more effectively the bias voltage applied to said intermediate transfer member moves to the transfer region. Conversely, when the volume resistivity of the surface layer is excessively low, a bias voltage leak occurs in the transfer region wherein the intermediate transfer member is in contact with the image-bearing member, such that there is a loss of transfer image resulting in image disruption.

Methods have been proposed to alleviate the aforesaid disadvantage, e.g., Japanese Laid-Open Patent Application No. HEI 4-335381, which discloses an intermediate transfer member having a multilayer construction. This intermediate transfer member having a multilayer construction comprises three layers, i.e., a substrate formed of electrically conductive material such as metal and the like, an intermediate layer formed of rubber, resin, expanded resin and the like, and a thin surface layer formed of rubber or resin. In this prior art, the intermediate layer is formed of a member having an extremely low volume resistivity of about $10^2$~$10^3$ Ωcm to allow the action of the applied bias voltage to be effective to the transfer region, and the surface layer is formed of a member having a volume resistivity which is higher than the intermediate layer of about $10^6$~$10^{16}$ Ωcm and which possesses a resistance regulating function to prevent leakage of the applied bias voltage to the surface of the image-bearing member.

In the above construction, the formation is difficult because the surface layer is extremely thin, i.e., less than several hundred micrometers, making high precision techniques necessary to adjust the resistance of the member. In particular, when conductive materials such as carbon black and the like are dispersed in high-molecular materials to adjust resistance when forming the surface layer, local resistance irregularities readily occur in the mid-to-high resistance range of $10^6$~$10^{16}$ Ωcm due to poor dispersion of carbon black or the like, and such local resistance irregularities cause disruption of the transfer image; it is also extremely difficult to control resistance within the aforesaid range. Furthermore, an extremely thin surface layer is formed in the aforesaid prior art, such that over long-term use said thin surface layer will experience local shaving which causes minute defects such as pinholes and the like. Because the surface layer has a resistance regulating function, the bias voltage may leak at pinholes, causing image irregularities. When the intermediate transfer member is constructed with local resistance irregularities in each layer, voltage nonuniformity is greatly intensified relative to the photosensitive member although the surface layer of the intermediate transfer member has high resistance, thereby producing disruption of the transfer image.

SUMMARY OF THE INVENTION

A main object of the present invention is to provide an intermediate transfer member capable of forming excellent images.

Another object of the present invention is to provide an intermediate transfer member for use in an image forming method using an intermediate transfer member having a multilayer construction which allows easy manufacture of a uniform surface layer of said intermediate transfer member, and which does not have minute defects such as pinholes and the like on the surface of the transfer member, thereby avoiding bias voltage leakage and minimizing transfer image disruption.

Still another object of the present invention is to provide an intermediate transfer member suitable for image forming apparatus using a wet developing method, which suppresses image disruptions caused by resistance irregularities of the construction materials.

The present invention achieves the aforesaid objects by providing an intermediate transfer member for use in image forming apparatus which produce images by transferring a toner image formed on an image-bearing member to an intermediate transfer member, and transferring the toner image held on said intermediate transfer member to a recording medium, wherein said intermediate transfer member comprises at least three layers of a conductive substrate, intermediate layer, and surface layer, and the volume resistivity of said surface layer is lower than the volume resistivity of said intermediate layer.

DETAILED DESCRIPTION OF THE PREFERRED EMBODIMENTS

The preferred embodiments of the present invention are described hereinafter with reference to the accompanying drawings.

The wet-type image forming apparatus shown in FIG. 1 which incorporates the intermediate transfer member of the present invention is described below.

Figure 1:
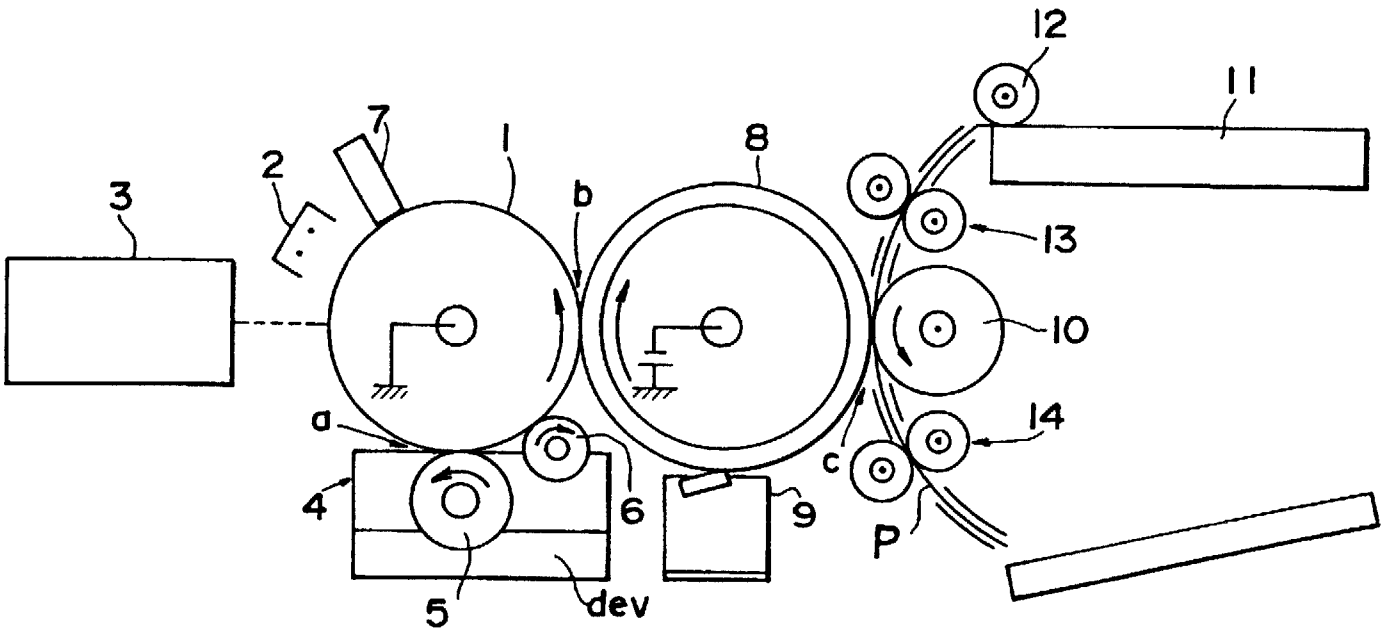
FIG. 1 shows a wet-type image forming apparatus which forms images using the intermediate transfer member of the present invention.

In the image forming apparatus of FIG. 1, reference number 1 refers to a photosensitive drum, i.e., an electrostatic latent image-bearing member, rotatably driven in the arrow direction, said photosensitive drum comprising a photosensitive layer superimposed on a conductive drum formed of aluminum, and wherein said drum is grounded. Arranged around the periphery of photosensitive drum 1 are scorotron charger 2, i.e., a charging device, for uniformly charging the surface of the latent image-bearing member, laser scanner 3, i.e., an optical exposure device, for exposing an optical image on the surface of said latent image-bearing member, developing device 4 which internally accommodates a liquid developer, intermediate transfer member 8 driven synchronously with photosensitive drum 1, and discharger 7 for discharging the residual charge remaining on the surface of the latent image-bearing member.

Provided around the periphery of intermediate transfer member 8 are transfer roller 10 which transfers the toner image on intermediate transfer member 8 to a sheet transported from cassette 11, and cleaning device 9 which removes residual toner from the surface of intermediate transfer member 8. Developing device 4 comprises a developing roller 5 for supplying a liquid developer to photosensitive drum 1, and squeeze roller 6 for removing liquid adhering to the surface of photosensitive drum 1. A bias voltage is applied to the support member of intermediate transfer member 8. In the drawing, reference number 12 refers to a take-up roller for feeding sheets from cassette 11, and reference numbers 13 and 14 refer to a pair of transport rollers respectively arranged on the upstream side and downstream side of transfer roller 10 for transporting fed transfer sheets.

In the aforesaid image forming apparatus, the surface of photosensitive drum 1 is uniformly charged to a predetermined potential by scorotron charger 2, then an electrostatic latent image is formed on the surface of photosensitive drum 1 via exposure light emitted from laser scanner 3 based on image information. The electrostatic latent image formed on the surface of photosensitive drum 1 is developed as a toner image by liquid developer accommodated in a developer tank within developing device 4 that is scooped by developing roller 5 and supplied to developing region a formed in the region of confrontation between developing roller 5 and photosensitive drum 1. Thereafter, the excess fluid medium in the liquid developer adhering to the surface of photosensitive drum 1 is squeezed by squeeze roller 6, such that the toner image on the surface of photosensitive drum 1 is regulated to a state which includes a slight amount of fluid. This toner image is transported to a first transfer region b formed at the region of confrontation between photosensitive drum 1 and intermediate transfer member 8 by the rotation of photosensitive drum 1, where said toner image is electrostatically transferred onto intermediate transfer member 8 (primary transfer) by a voltage applied to said intermediate transfer member 8.

The toner image maintained on the surface of intermediate transfer member 8 is then transported to a second transfer region c formed at the region of confrontation between intermediate transfer member 8 and transfer roller 10 via the rotation of said intermediate transfer member 8, where a heat and pressure transfer (secondary transfer) is accomplished via transfer roller 10 onto a transfer sheet P fed thereto from paper cassette 11 via take-up roller 12 and pair of transport rollers 13, with the result that a fixed image is obtained. At this time, transfer roller 10 is heated by a heating means not shown in the drawing.

Figure 2:
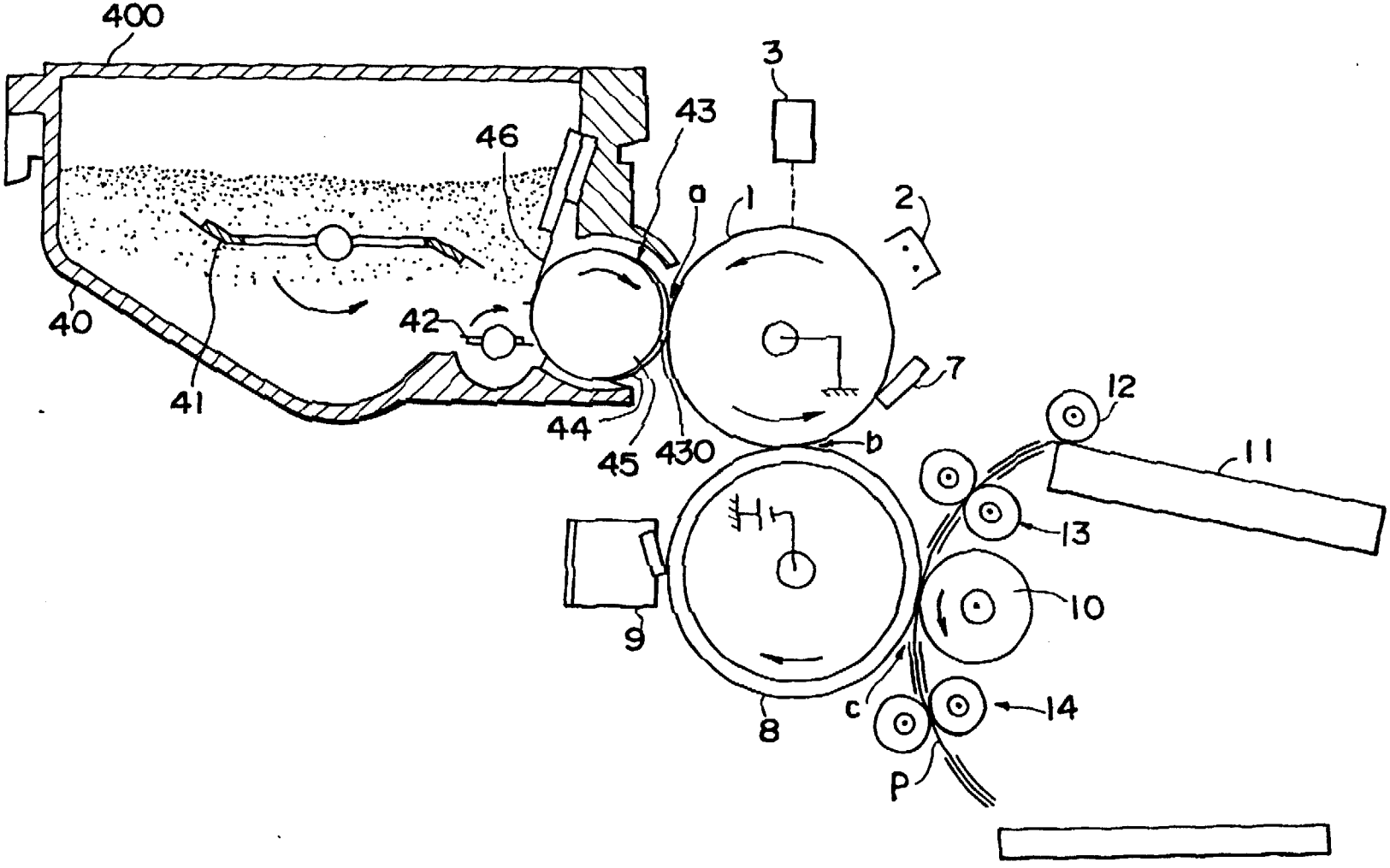
FIG. 2 shows a dry-type image forming apparatus using the intermediate transfer member of the present invention.

The image forming apparatus using a dry-type developing method and incorporating the intermediate transfer member of the present invention as shown in FIG. 2 is described below. This apparatus is essentially identical to the previously described apparatus with the exception that the developing device 4 in the aforesaid image forming apparatus using a wet-type developing method is replaced by a dry-type developing device 400. Thus, like parts are designated by like reference numbers.

Developing device 400 accommodates a dry-type monocomponent developer in developer tank 40, and is provided with mixing members 41 and 42 which rotate in the arrow directions within said tank 40. Reference number 43 refers to a supply roller that supplies toner to the photosensitive member, and which comprises a conductive cylindrical resin layer 44 having a layer thickness of 200 μm and internal diameter of 30 mm covering the exterior of a developing roller 45 formed of conductive expanded silicone rubber and having a interior diameter of 27 mm. Cylindrical resin layer 44 is formed of nylon 12, and has a surface roughness Rz=5 μm. When developing roller 45 is rotatably driven in the arrow direction by a drive means not shown in the drawing, cylindrical resin layer 44 is also rotated in the arrow direction via a friction force between said layer 44 and the exterior surface of developing roller 45.

A regulating member 46 is anchored to the interior wall of developer tank 40 so as to be cantilevered by its top end. Regulating member 46 is a flat plate formed of special use stainless steel, positioned so as to be parallel to the photosensitive member in the lengthwise direction, and the free end of said member is pressed against the cylindrical resin layer 44 at a pressure of about 3.5 g/mm. Thus, an empty space 430 is formed between developing roller 45 and cylindrical resin layer 44 at developing region a at which supply roller 43 confronts the photosensitive member. This region makes contact with photosensitive drum 1 to form a toner image.

Other aspects of construction are identical to the apparatus shown in FIG. 1 and, thus, further description is omitted.

As previously described, intermediate transfer member 8 may be used with either dry-type developing methods or wet-type developing methods, and is particularly effective when used in image forming apparatus using wet-type developing methods utilizing a fine toner compared to dry-type developing methods.

Figure 3:
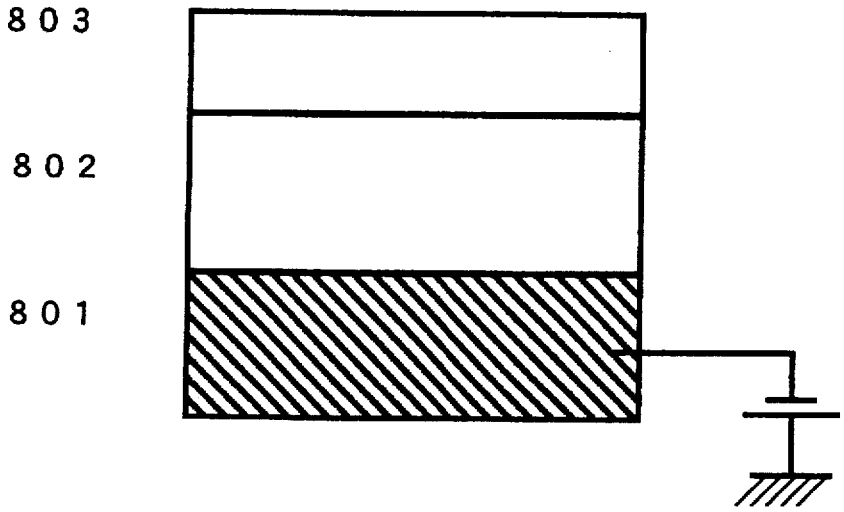
FIG. 3 shows the intermediate transfer member of the present invention.

Intermediate transfer member 8 comprises sequentially from the interior side a conductive substrate 801, an intermediate layer 802, and a surface layer 803, as shown in FIG. 3. The volume resistivity of surface layer 803 is lower than the volume resistivity of intermediate layer 802, so as to provide a high transfer efficiency by maintaining the resistance regulating function of intermediate layer 802, and thereby strongly suppress loss of image quality due to image disruption or image nonuniformity.

Examples of materials usable as conductive substrate 801 of the intermediate transfer member include metal materials such as aluminum, iron, stainless steel and the like, or resins or paper which has been subjected to surface treatment for conductivity. The configuration of said substrate is not particularly limited, and may be a suitable shape such as a drum or belt.

Examples of materials usable as the intermediate layer 802 formed on the aforesaid substrate include rubber and resin. Specific examples include, rubbers such as nitrile rubber (acrylonitrile-butadiene copolymer), chloroprene rubber (polychloroprene), ethylene, propylene rubber (ethylene-propylene-terpolymer), silicone rubber (polysiloxane), butyl rubber (isoprene-isobutylene copolymer), styrene rubber (styrene-butadiene copolymer), urethane rubber (polyurethane), chlorosulfonated polyethylene rubber, fluoro rubber (fluorohydrocarbon), epichlorohydrin rubber and the like, polycarbonate resin, silicon resin, polyimide resin and the like. A desired resistance value may be achieved by adding conductive materials as described below.

The intermediate layer construction materials may be expanded, or partially hollow to improve cushioning for purposes of contact stability of the image-bearing member or paper with the roller, assuring the nip width, pressure adjustment and the like. The intermediate layer 802 may itself have a multilayer construction, so as to provide a cushion function or resistance regulating function in separate layers.

The volume resistivity of intermediate layer 802 should be adjusted within a range to allow adequately high transfer efficiency and prevent leaks of the bias voltage between said layer and the image-bearing member. When the volume resistivity value is greater than $10^{10}$ Ωcm, the transfer efficiency tends to drop because sufficient bias voltage is not supplied to the transfer region, whereas when the volume resistivity is less than $10^6$ Ωcm, image disruption may occur due to bias voltage leakage; thus, the volume resistivity of intermediate layer 802 is set within the range of $10^6$~$10^{10}$ Ωcm. The thickness of intermediate layer 802 is not specifically limited insofar as the previously described effectiveness is achieved and say layer is easily formed; a thickness of about 1~20 mm is desirable, and a thickness of about 1~10 mm is preferable. When the aforesaid layer thickness is exceeded, it becomes difficult for the applied bias voltage to adequately move to the transfer region, thereby reducing the transfer efficiency, whereas when the lower limit of layer thickness is exceeded, the resistance regulating function is reduced making the desired effectiveness of the present invention unobtainable.

The intermediate transfer member 8 of the present invention is provided with a surface layer 803 superimpose over the aforesaid intermediate layer 802.

The construction materials of the surface layer 803 may be identical to the materials of intermediate layer 802. the resistance of the surface layer may be adjusted to a desired resistance value by adding conductive materials described later.

The surface layer 803 of the intermediate transfer member may have an adjusted surface roughness to improve transfer efficiency. In general, methods for adjusting surface roughness such as blasting, etching, thermal transfer, abrasion and the like may be considered, however, regardless of the method used, it is desirable that the surface roughness be about 0.5 times to 10 times the toner particle size. When the surface is too rough, nonprinting areas of the image occur during transfer, thereby adversely affecting the reproducibility of halftone images. When the surface roughness is too smooth, the friction coefficient with respect to the recording medium becomes too large, thereby causing poor separation which leads to paper jams. When the friction coefficient between the toner particles and the surface layer 803 is too low, adverse affects result including slippage between the surface layer and image-bearing member. A friction coefficient of about 0.2~1 is desirable.

The volume resistivity of the surface layer 803 is preferably $10^2$~$10^5$ Ωcm. This range is suitable for producing uniformity in the horizontal direction, i.e., the lengthwise direction of the intermediate transfer member, despite nonuniformity of the charge applied to surface layer 803 due to resistance irregularities of intermediate layer 802. When volume resistivity is greater than $10^5$ Ωcm, load uniformity is reduced, causing image irregularity due to nonuniform resistance of the intermediate layer 802. When volume resistivity is less than $10^2$ Ωcm, bias voltage leaks from the image-bearing member side to the intermediate transfer member side due to pinhole defects of the image-bearing member, such that the electrostatic latent image is uniform in the horizontal direction (i.e., lengthwise direction of the image-bearing member) at the contact region (nip) between the image-bearing member and the intermediate transfer member, which produces black streaks during development.

Resistance fluctuation can be minimized even when a thin layer surface layer 803 is used by setting the volume resistivity of surface layer 803 at about $10^2$~$10^5$ Ωcm, thereby suppressing image irregularities due to nonuniform resistance.

The layer thickness of the surface layer 803 is not specifically restricted insofar as the previously described effectiveness is obtained, but a thickness of about 1~1,000 μm is desirable, and a thickness of a bout 5~200 μm is preferable. When the layer thickness is too thin, the effectiveness offered by the present invention are not obtainable, and stable characteristics cannot be maintained over a long term due to extreme influence of wear. When the layer thickness is too large, transfer efficiency os reduced because it becomes difficult for the bias voltage to travel to the transfer region.

When the layer thickness of the surface layer 803 is about 1~40 μm, it is desirable to use a dipping method, casting method, spray method or the like to apply a liquid application of rubber or resin or the like having conductive additives dispersed therein for resistance regulation over the aforesaid intermediate layer 802, said liquid application then being dried thereon. The layer thickness and layer roughness may be adjusted via abrasion or blasting methods as needed. When a thicker layer thickness of about 40~700 μm is desired for surface layer 803, a tube of rubber or resin may be manufactured by an extrusion method or compression molding method or the like, which is then used to cover intermediate layer 802 and subjected to heat-shrinking.

Examples of conductive materials useful for resistance regulation of intermediate layer 802 or surface layer 803 include conductive high-molecular materials such as conductive carbon, metal powder, polyacetylene, polytheophene, polypyrole and the like, or ceramic materials such as silicon carbonate, barium nitrate and the like. The resistivity of the intermediate layer 802 and surface layer 803 may be controlled by the amount of added conductive material. Although the additive amount and physical characteristics of the added conductive material are not stipulated and may differ, materials wherein carbon black is added to silicone rubber, epichlorohydrin rubber and like multipurpose rubbers, volume resistivity can be controlled to $10^6$~$10^{10}$ Ωcm by adding about 5~25 parts carbon black relative to the rubber material. Volume resistivity can be controlled to $10^2$~$10^5$ Ωcm by adding more than 25 parts carbon black relative to the rubber material. When highly conductive carbon black, e.g., kitchen black, is used, a desired volume resistivity can be achieved with a minimum amount of additive.

Volume resistivity of $10^6$~$10^{10}$ Ωcm of intermediate layer 802 of the intermediate transfer member of the present invention is within a range which readily produces the previously mentioned nonuniform resistance, it is difficult for said nonuniform resistance to occur when the thickness of intermediate layer 802 is sufficiently thick compared to the thickness of surface layer 803. Conversely, image irregularities are suppressed via the effects of the surface layer 803 even when there is local nonuniform resistance due to inadequate dispersion of the conductive material.

In the aforesaid image forming apparatus, the secondary transfer is accomplished by a heat and pressure transfer, the present invention is not limited to this arrangement, inasmuch as said secondary transfer may be accomplished by electrostatic transfer with fixing accomplished by a fixing device after said secondary transfer. In order to obtain even better transfer efficiency, it is desirable to use a heat and pressure transfer in the secondary transfer process of transferring a toner image from the intermediate transfer member to a final medium. This heat and pressure transfer presses the intermediate transfer member against the final medium via a backup heating roller, fuses the toner by heating, and fixing the toner simultaneously with the transfer. When accomplishing the transfer by heat and pressure, particularly excellent separation characteristics are exhibited between the toner particles and the intermediate transfer member, and offset phenomenon during fixing does not occur because toner particles are prevented from adhering to roller and intermediate transfer member due to the low moisture content, thereby assuring long-term stability of the intermediate transfer member. It is particularly desirable that silicone rubber, epichlorohydrin rubber or like heat resistant high-molecular material is used as the material for surface layer 803 to provide heat-resistance for the intermediate transfer member.

The toner used in the wet-type image forming apparatus of FIG. 1 may be any among various well-known toners, but small particle toners are extremely effective when used with the intermediate transfer member of the present invention. In general, when small size toner is used, toner load is high although finely detailed images can be obtained. When the toner load is excessively high, transfer bias irregularities caused by nonuniform resistance of the intermediate transfer member are faithfully reproduced, thereby intensifying transfer image irregularities. Therefore, when the intermediate transfer member of the present invention is used, the volume average particle size d50 of the toner particles is desirably 0.2~5.0 μ m, and preferably 0.5~3.0 μm, to markedly reduce the transfer image irregularities. The lower limit of the aforesaid value d50 is a value which does not cause inadequate transfer.

The distribution of the volume average particle size of toner particles may be sharp, such that 80 vol % of the total amount of toner particles is desirably d50±1.0 μm, and preferably d50±0.5 μm. Particularly in wet-type developing methods, when the particle size distribution is broad, large size toner particles are used for development, thereby changing the characteristics of the developer after long-term use.

EXPERIMENTAL EXAMPLES

Experimental examples of the present invention are described in detail below. In the following examples, "parts" refers to "parts by weight" unless specified otherwise, and "d50" refers to "volume average particle size."

When constructing the intermediate transfer member, the volume resistivities of the intermediate layer and surface layer are values measured by selecting individual materials of said layers, and measuring using a high-resistance resistivity meter (model Hiresta-IP) and low-resistance resistivity meter (model Loresta-AP; both manufactured by Mitsubishi Yuuka K.K.).

Manufacture of Liquid Developer

One hundred parts low-molecular weight polyester resin (Mw: 15,000; Mn: 6,000) were completely dissolved in toluene to achieve 1.5 percent-by-weight. Using an Eiger motor mill (Eiger Japan, Ltd.), 6 parts phthalocyanine was dispersed in the aforesaid resin solution as a colorant.

Using the resin solution obtained above, spray granulation was performed using a Disparcoat device (Nissei Engineering) under conditions of fluid application speed of 1 liter, drying temperature of 80° C., and spray pressure of 5.5 kgf/cm2 to obtain fine polymer particles used as toner having a value d50=2.0 μm.

To 100 parts electrically insulated isoparaffin solvent IP solvent 1620 (Idemitsu Sekiyu Kagaku K.K.) were added 3 parts toner polymer particles, then 0.7 parts lauryl methacrylate-vinyl pyrrolidone copolymer (lauryl methacrylate/vinyl pyrrolodine: 95/5) was added, and the mixture was mixed for 20 min using an ultrasonic dispersion device to obtain a liquid developer.

Manufacture of Dry-type Developer

One hundred parts of the aforesaid low-molecular weight polyester resin (Mw: 15,000; Mn: 6,000), 5 parts carbon black MA#8 (Mitsubishi Kasei K.K.), 3 parts Bontron S-34 (Oriental Kagaku K.K.), and 2.5 parts biscol TS-200 (Sanyo Kasei K.K.) were mixed and coarsely pulverized, then finely pulverized using a jet mill and classified to obtain fine polymer particles used for toner having a value d50=6.5 μm.

To these polymer particles were added 0.75 parts hydrophobic silica Tullanox 500 (Tulco K.K.) as a fluidizing agent, and the mixture was mixed in an homogenizer for 1 min at 2,0000 rpm to obtain a dry-type developer.

Intermediate Transfer Member A

To 100 parts acrylic rubber Nipol AR32 (Japan Zeon) were added 20 parts conductive carbon black, and the mixture was vulcanized at 155° C. for 30 min to obtain the intermediate layer rubber. This rubber was compression molded on a 80 mm diameter aluminum tube to produce an 88 mm exterior diameter thereon.

To 100 parts FS XF-2560 (Dow-Corning) were added 30 parts conductive carbon black, and the mixture was mixed and applied to the surface of the aforesaid tube by a dipping method, then dried to form a silicone overcoat layer about 10 μ m in thickness as a surface layer to obtain intermediate transfer member A.

The volume resistivities of the intermediate layer and the surface layer of the aforesaid intermediate transfer member were $1.6\times10^6$ Ωcm and $7.9\times10^4$ Ωcm, respectively.

Intermediate Transfer Member B

To 100 parts epichlorohydrine rubber Herclor (Japan Zeon) was added 17 parts conductive carbon black, and the mixture was vulcanized at 155° C. for 30 min to obtain the intermediate layer rubber. This rubber was compression molded on a 80 mm diameter aluminum tube to produce an 88 mm exterior diameter thereon.

To 100 parts FS XF-2560 (Dow-Corning) were added 30 parts conductive carbon black, and the mixture was mixed and applied to the surface of the aforesaid tube by a dipping method, then dried to form a silicon overcoat layer about 10 μm in thickness as a surface layer to obtain intermediate transfer member B.

The volume resistivities of the intermediate layer and the surface layer of the aforesaid intermediate transfer member were $4.2\times10^8$ Ωcm and $7.9\times10^4$ Ωcm, respectively.

Intermediate Transfer Member C

To 100 parts silicone rubber SH-410 (Toray Dow-Corning) were added 15 parts conductive carbon black, and to this mixture was added a suitable amount of vulcanizing agent RC-3 (Toray Dow-Corning), and the mixture was vulcanized at 150° C. for 30 min to obtain the intermediate layer rubber. This rubber was compression molded on a 80 mm diameter aluminum tube to produce an 88 mm exterior diameter thereon.

To 100 parts nylon 12 were added 25 parts conductive carbon black, and the mixture was thoroughly kneaded and dispersed using a kneader. The obtained compound was formed as a tube using an extrusion molding device at about 270° C., and the tube was thereafter subjected to an elongation process to form a tube used as a surface layer having an internal diameter of 88.5 mm and a thickness of 200 μm. This tube was used to cover an aluminum tube having the aforesaid intermediate layer formed thereon, and said tube was subjected to heat-shrinking at about 150° C., so as to form an intermediate transfer member C having a surface layer bonded over an intermediate layer.

The volume resistivities of the intermediate layer and the surface layer of the aforesaid intermediate transfer member were $8.6\times10^7$ Ωcm and $3.8\times10^4$ Ωcm, respectively.

Intermediate Transfer Member D

To 100 parts acrylic rubber Nipol AR32 (Japan Zeon) were added 10 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 30 parts conductive carbon black, and the mixture was mixed and applied to the surface of the aforesaid tube by a dipping method, then dried to form a silicon overcoat layer about 10 μm in thickness as a surface layer to obtain intermediate transfer member D.

The volume resistivities of the intermediate layer and the surface layer of the aforesaid intermediate transfer member were $8.3\times10^9$ Ωcm and $7.9\times10^4$ Ωcm, respectively.

Intermediate Transfer Member E

To 100 parts acrylic rubber Nipol AR32 (Japan Zeon) were added 10 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 40 parts conductive carbon black, and the mixture was mixed and applied to the surface of the aforesaid tube by a dipping method, then dried to form a silicon overcoat layer about 10 μm in thickness as a surface layer to obtain intermediate transfer member E.

The volume resistivities of the intermediate layer and the surface layer of the aforesaid intermediate transfer member were $8.3\times10^9$ Ωcm and $5.1\times10^2$ Ωcm, respectively.

Intermediate Transfer Member F

To 100 parts acrylic rubber Nipol AR32 (Japan Zeon) were added 35 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 10 parts conductive carbon black, and the mixture was mixed and applied to the surface of the aforesaid tube by a dipping method, then dried to form a silicon overcoat layer about 10 μm in thickness as a surface layer to obtain intermediate transfer member F.

The volume resistivities of the intermediate layer and the surface layer of the aforesaid intermediate transfer member were $1.6\times10^6$ Ωcm and $5.1\times10^2$ Ωcm, respectively.

Intermediate Transfer Member G

To 100 parts acrylic rubber Nipol AR32 (Japan Zeon) were added 25 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 30 parts conductive carbon black, and the mixture was mixed and applied to the surface of the aforesaid tube by a dipping method, then dried to form a silicon overcoat layer about 10 μm in thickness as a surface layer to obtain intermediate transfer member G.

The volume resistivities of the intermediate layer and the surface layer of the aforesaid intermediate transfer member were $3.2\times10^5$ Ωcm and $7.9\times10^4$ Ωcm, respectively.

Intermediate Transfer Member H

To 100 parts acrylic rubber Nipol AR32 (Japan Zeon) were added 5 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 30 parts conductive carbon black, and the mixture was mixed and applied to the surface of the aforesaid tube by a dipping method, then dried to form a silicon overcoat layer about 10 μm in thickness as a surface layer to obtain intermediate transfer member H.

The volume resistivities of the intermediate layer and the surface layer of the aforesaid intermediate transfer member were $7.1\times10^{10}$ Ωcm and $7.9\times10^{4}$ Ωcm, respectively.

Intermediate Transfer Member I

To 100 parts acrylic rubber Nipol AR32 (Japan Zeon) were added 10 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 20 parts conductive carbon black, and the mixture was mixed and applied to the surface of the aforesaid tube by a dipping method, then dried to form a silicon overcoat layer about 10 μm in thickness as a surface layer to obtain intermediate transfer member I.

The volume resistivities of the intermediate layer and the surface layer of the aforesaid intermediate transfer member were $8.3\times10^{9}$ Ωcm and $1.6\times10^{5}$ Ωcm, respectively.

Intermediate Transfer Member J

To 100 parts acrylic rubber Nipol AR32 (Japan Zeon) were added 10 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 60 parts conductive carbon black, and the mixture was mixed and applied to the surface of the aforesaid tube by a dipping method, then dried to form a silicon overcoat layer about 10 μm in thickness as a surface layer to obtain intermediate transfer member J.

The volume resistivities of the intermediate layer and the surface layer of the aforesaid intermediate transfer member were $8.3\times10^{9}$ Ωcm and $6.4\times10^{1}$ Ωcm, respectively.

Intermediate Transfer Member K

To 100 parts acrylic rubber Nipol AR32 (Japan Zeon) were added 35 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 10 parts conductive carbon black, and the mixture was mixed and applied to the surface of the aforesaid tube by a dipping method, then dried to form a silicon overcoat layer about 10 μm in thickness as a surface layer to obtain intermediate transfer member K.

The volume resistivities of the intermediate layer and the surface layer of the aforesaid intermediate transfer member were $6.6\times10^{3}$ Ωcm and $4.9\times10^{8}$ Ωcm, respectively.

Intermediate Transfer Member L

To 100 parts acrylic rubber Nipol AR32 (Japan Zeon) were added 20 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 5 parts conductive carbon black, and the mixture was mixed and applied to the surface of the aforesaid tube by a dipping method, then dried to form a silicon overcoat layer about 10 μm in thickness as a surface layer to obtain intermediate transfer member L.

The volume resistivities of the intermediate layer and the surface layer of the aforesaid intermediate transfer member were $1.6\times10^{9}$ Ωcm and $2.7\times10^{11}$ Ωcm, respectively.

Intermediate Transfer Member M

To 100 parts acrylic rubber Nipol AR32 (Japan Zeon) were added 30 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 15 parts conductive carbon black, and the mixture was mixed and applied to the surface of the aforesaid tube by a dipping method, then dried to form a silicon overcoat layer about 10 μm in thickness as a surface layer to obtain intermediate transfer member M.

The volume resistivities of the intermediate layer and the surface layer of the aforesaid intermediate transfer member were $5.4\times10^{4}$ Ωcm and $8.5\times10^{6}$ Ωcm, respectively.

Intermediate Transfer Member N

To 100 parts acrylic rubber Nipol AR32 (Japan Zeon) were added 40 parts conductive carbon black, and the mixture was vulcanized at 155° C. for 30 min to obtain intermediate layer rubber. This rubber was compression molded on a 80 mm diameter aluminum tube to produce an 88 mm exterior diameter thereon.

To 100 parts FS XF-2560 (Dow-Corning) were added 30 parts conductive carbon black, and the mixture was mixed and applied to the surface of the aforesaid tube by a dipping method, then dried to form a silicon overcoat layer about 10 μm in thickness as a surface layer to obtain intermediate transfer member N.

The volume resistivities of the intermediate layer and the surface layer of the aforesaid intermediate transfer member were $9.1\times10^{2}$ Ωcm and $7.9\times10^{4}$ Ωcm, respectively.

Intermediate Transfer Member O

To 100 parts acrylic rubber Nipol AR32 (Japan Zeon) were added 10 parts conductive carbon black, and the mixture was vulcanized at 155° C. for 30 min to obtain a surface layer without using an intermediate layer. This rubber was compression molded on a 80 mm diameter aluminum tube to produce an 88 mm exterior diameter thereon, so as to form intermediate transfer member O.

The volume resistivity of the surface layer of the aforesaid intermediate transfer member was $5.4\times10^{4}$ Ωcm, respectively.

Intermediate Transfer Member P

To 100 parts acrylic rubber Nipol AR32 (Japan Zeon) were added 20 parts conductive carbon black, and the mixture was vulcanized at 155° C. for 30 min to obtain a surface layer without using an intermediate layer. This rubber was compression molded on a 80 mm diameter aluminum tube to produce an 88 mm exterior diameter thereon, so as to form intermediate transfer member P.

The volume resistivity of the surface layer of the aforesaid intermediate transfer member was $1.6\times10^{6}$ Ωcm, respectively.

Intermediate Transfer Member Q

To 100 parts acrylic rubber Nipol AR32 (Japan Zeon) were added 5 parts conductive carbon black, and the mixture was vulcanized at 155° C. for 30 min to obtain a surface layer without using an intermediate layer. This rubber was compression molded on a 80 mm diameter aluminum tube to produce an 88 mm exterior diameter thereon, so as to form intermediate transfer member Q.

The volume resistivity of the surface layer of the aforesaid intermediate transfer member was $7.1\times10^{10}$ Ωcm, respectively.

Experimental Examples 1~10

The previously described liquid developer and intermediate transfer members A~J were installed in a wet-type image forming apparatus shown in FIG. 1, and evaluated per the criteria described later.

Experimental Examples 11~12

The previously described dry developer and intermediate transfer members A and B were installed in a dry-type image forming apparatus shown in FIG. 2, and evaluated per the criteria described later.

Reference Examples 1~7

The previously described liquid developer and intermediate transfer members K~Q were installed in a wet-type image forming apparatus shown in FIG. 1, and evaluated per the criteria described later.

Reference Examples 8~9

The previously described dry developer and intermediate transfer members K and L were installed in a dry-type image forming apparatus shown in FIG. 2, and evaluated per the criteria described later.

Evaluations

Each experimental example and reference example were evaluated for transfer efficiency, image irregularity, and long-term print resistance. Evaluation results are shown in Table 1.

In the wet-type image forming apparatus of FIG. 1 and the dry-type image forming apparatus of FIG. 2, the photosensitive drum 1 was charged to a surface potential of about −1,000 V, the rotational speed of the photosensitive drum 1 was 20 cm/sec, a bias voltage of −1,000 V was applied to intermediate transfer member 8, and transfer roller 10 was heated to a temperature of 200° C.

In the wet-type image forming apparatus of FIG. 1, the peripheral speed ratio of the developing roller and photosensitive drum (rotational speed of developing roller/rotational speed of photosensitive drum) was 10.

Transfer Efficiency

Solid images were output using the image forming apparatuses shown in FIGS. 1 and 2, the after the solid image was transferred from the intermediate transfer member to the transfer sheet (secondary transfer), the amount of toner adhered to the transfer sheet and the amount of residual toner remaining on the surface of the intermediate transfer member were measured. The transfer efficiency was determined and ranked as shown below; a rank of Δ or better was acceptable.

Transfer efficiency=(amount of developer on sheet)/(amount of developer on sheet+amount of residual developer)

⊙: transfer efficiency of 95% or higher

○: transfer efficiency of 80% or higher but less than 95%

Δ: transfer efficiency of 60 or higher but less than 80%

X: transfer efficiency of less than 60%

Image Irregularity

Solid images and half images were output using the image forming apparatuses shown in FIGS. 1 and 2, after the solid image and half image were transferred, the obtained images were checked for defects such as black dots and non-printing spots. Image irregularity was ranked as shown below; a rank of Δ or better was acceptable.

○: no image defects

Δ: percentage of black dots and nonprinting less than 5% per total image

X: percentage of black dots and nonprinting 5% or greater but less than 10% per total image XX: percentage of black dots and nonprinting 10% or higher per total image Long-term Use Characteristics The image forming apparatus of FIGS. 1 and 2 were used to print 10,000 sample images having a 5% B/W (black-to-white) ratio, and subsequently a lattice image having 25 μm line width was output and compared to the initial image. Long-term characteristics were ranked as shown below; a rank of Δ or better was acceptable. In Table 1, the asterisk symbol (*) indicates image disruption by bias voltage leakage after initial use due to excessively low resistance value of the intermediate transfer member.

○: no image disruption

Δ: image disruption after 10,000 printings, but poses no practical problem

X: image disruption after 5,000 printings

"B/W ratio" expresses the ratio of black (image region) to white (paper surface).

TABLE 1

| | Inter. Layer Vol. Resistivity | Surface Layer Vol. Resistivity | Evaluation Transfer Efficiency | Image Irregularity | Longterm Use |
|---|---|---|---|---|---|
| Ex. 1 | $1.6\times10^{6}$ | $7.9\times10^{4}$ | ⊙ | ○ | ○ |
| Ex. 2 | $4.2\times10^{8}$ | $7.9\times10^{4}$ | ⊙ | ○ | ○ |
| Ex. 3 | $8.6\times10^{7}$ | $3.8\times10^{4}$ | ⊙ | ○ | ○ |
| EX. 4 | $8.3\times10^{9}$ | $7.9\times10^{4}$ | ○ | ○ | ○ |
| Ex. 5 | $8.3\times10^{9}$ | $5.1\times10^{2}$ | ○ | ○ | ○ |
| Ex. 6 | $1.6\times10^{6}$ | $5.1\times10^{2}$ | ⊙ | ○ | ○ |
| Ex. 7 | $3.2\times10^{5}$ | $7.9\times10^{4}$ | ⊙ | ○ | Δ |
| Ex. 8 | $7.1\times10^{10}$ | $7.9\times10^{4}$ | Δ | ○ | ○ |
| Ex. 9 | $8.3\times10^{9}$ | $1.6\times10^{5}$ | Δ | Δ | ○ |
| Ex. 10 | $8.3\times10^{9}$ | $6.4\times10^{1}$ | ○ | ○ | Δ |
| Ex. 11 | $1.6\times10^{6}$ | $7.9\times10^{4}$ | ⊙ | ○ | ○ |
| Ex. 12 | $4.2\times10^{8}$ | $7.9\times10^{4}$ | ⊙ | ○ | ○ |
| Ref. 1 | $6.6\times10^{3}$ | $4.9\times10^{8}$ | ⊙ | XX | X |

TABLE 1-continued

| | Inter. Layer Vol. Resistivity | Surface Layer Vol. Resistivity | Transfer Efficiency | Evaluation Image Irregularity | Longterm Use |
|---|---|---|---|---|---|
| Ref. 2 | $1.6 \times 10^6$ | $2.7 \times 10^{11}$ | X | XX | ○ |
| Ref. 3 | $5.4 \times 10^4$ | $8.5 \times 10^6$ | ○ | XX | X |
| Ref. 4 | $9.1 \times 10^2$ | $7.9 \times 10^4$ | — | — | * |
| Ref. 5 | — | $5.4 \times 10^4$ | — | — | * |
| Ref. 6 | — | $1.6 \times 10^6$ | ○ | XX | ○ |
| Ref. 7 | — | $7.1 \times 10^{10}$ | Δ | XX | ○ |
| Ref. 8 | $6.6 \times 10^3$ | $4.9 \times 10^8$ | ⊙ | X | X |
| Ref. 9 | $1.6 \times 10^6$ | $2.7 \times 10^{11}$ | X | X | ○ |

Note: Reference examples 4 and 5 exhibited severe image disruption from the start, and could not be evaluated for transfer efficiency, image irregularities and the like.

As can be clearly understood from the above experimental examples and reference examples, the intermediate transfer member of the reference examples which maintained the resistance regulating function of surface layer 803 produced image irregularities from the start due to nonuniform resistance of the intermediate transfer member, and produced image disruption or reduced transfer efficiency due to bias voltage leakage after printing, whereas in the intermediate transfer member of the present invention, a high transfer efficiency was maintained, and the absence of image disruption even after long-term use was verified. The range of volume resistivity of the intermediate layer 802 was particularly excellent at $10^6$~$10^{10}$ Ω cm and the range of volume resistivity of the surface layer 803 was also excellent at $10^2$~$10^5$ Ωcm, and high evaluations were received for all categories of transfer efficiency, image irregularity, and long-term use characteristics.

As previously described a uniform surface layer 803 can be readily produced, high resolution characteristics which are characteristic of liquid developers can be maintained while suppressing image disruption due to resistance irregularities of the construction materials, so as to provide an intermediate transfer member which avoids changes in characteristics even with long-term use and excellent transfer efficiency.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An intermediate transfer member for use in image forming apparatus which produce images by transferring a toner image formed on an image-bearing member to an intermediate transfer member, and transferring the toner image held on said intermediate transfer member to a recording medium, wherein said intermediate transfer member comprises at least three layers of a conductive substrate, intermediate layer, and surface layer, and the volume resistivity of said surface layer is lower than the volume resistivity of said intermediate layer, wherein the volume resistivity of said intermediate layer is set within the range of $10^6$~$10^{10}$ Ω cm and the volume resistivity of said surface layer is set within the range of $10^2$~$10^5$ Ωcm.

2. An intermediate transfer member as claimed in claim 1, wherein the thickness of said intermediate layer is about 1~10 mm and the thickness of said surface layer is 1~1,000 μm.

3. An intermediate transfer member as claimed in claim 1, wherein the resistance of the intermediate layer and the surface layer is adjusted by adding conductive materials therein.

4. An image forming apparatus comprising:

a photosensitive member;

a charging device opposed to the photosensitive member to charge the surface of the photosensitive member;

an optical exposure device for exposing an image on the surface of the photosensitive member;

a developing device for developing a latent image formed on the surface of the photosensitive member by toner;

an intermediate transfer member driven synchronously with said photosensitive member, said intermediate transfer member including at least three layers of a conductive substrate, intermediate layer, and surface layer, and the volume resistivity of said surface layer being lower than the volume resistivity of said intermediate layer, wherein the volume resistivity of said intermediate layer is set within the range of $10^6$~$10^{10}$ Ωcm and the volume resistivity of said surface layer is set within the range of $10^2$~$10^5$ Ωcm; and transfer means for transferring the toner image on the intermediate transfer member to a sheet.

5. An image forming apparatus as claimed in claim 4, whrerein said developing device includes a developing roller for supplying a liquid developer to the photosensitive member.

6. An image forming apparatus as claimed in claim 4, wherein a bias voltage is applied to the conductive substrate of the intermediate transfer member.

7. An image forming apparatus as claimed in claim 4, wherein the surface roughness of the intermediate transfer member is about 0.5 times to 10 times the toner particle size.

8. An intermediate transfer member for use in image forming apparatus which produce images by transferring a toner image formed on an image-bearing member to an intermediate transfer member, and transferring the toner image held on said intermediate member to a recording medium, wherein said intermediate transfer member comprises at least three layers of a conductive substrate, intermediate layer having the volume resistivity of $10^6$~$10^{10}$ Ωcm, and surface layer, and the volume resistivity of said surface layer is lower than the volume resistivity of said intermediate layer.

9. An image forming apparatus comprising:

a photosensitive member;

a charging device opposed to the photosensitive member to charge the surface of the photosensitive member;

an optical exposure device for exposing an image on the surface of the photosensitive member;

a developing device for developing a latent image formed on the surface of the photosensitive member by toner;

an intermediate transfer member for use in image forming apparatus which produces images by transferring a toner image formed on an image-bearing member to an intermediate transfer member, and transferring the toner image held on said intermediate member to a recording medium, wherein said intermediate transfer member comprises at least three layers of a conductive substrate, intermediate layer having the volume resistivity of $10^6$~$10^{10}$ Ωcm, and surface layer, and the volume resistivity of said surface layer is lower than the volume resistivity of said intermediate layer; and transfer means for transferring the toner image on the intermediate transfer member to a sheet.

* * * * *